US011553263B1

(12) United States Patent
Hsu et al.

(10) Patent No.: US 11,553,263 B1
(45) Date of Patent: Jan. 10, 2023

(54) SOUND BOX STRUCTURE

(71) Applicant: Vanson Electronics (Nanhai) Co., Ltd., Foshan (CN)

(72) Inventors: Ching-Shan Hsu, Taipei (TW); Hao-Chien Hsu, Taipei (TW)

(73) Assignee: Vanson Electronics (Nanhai) Co., Ltd.

( * ) Notice: Subject to any disclaimer, the term of this patent is extended or adjusted under 35 U.S.C. 154(b) by 0 days.

(21) Appl. No.: 17/513,880

(22) Filed: Oct. 29, 2021

(51) Int. Cl.
*H04R 1/02* (2006.01)
*H04R 9/02* (2006.01)

(52) U.S. Cl.
CPC ..... *H04R 1/02* (2013.01); *H04R 9/02* (2013.01)

(58) Field of Classification Search
CPC ..... H04R 1/02; H04R 9/02
USPC ..... 381/332, 333
See application file for complete search history.

(56) References Cited

U.S. PATENT DOCUMENTS 4,451,928 A * 5/1984 Murayama ..... H04R 1/02 381/86

* cited by examiner

*Primary Examiner* — Ammar T Hamid
(74) *Attorney, Agent, or Firm* — Winston Hsu

(57) ABSTRACT

The invention discloses a sound box structure including a speaker unit and a sound box housing. The speaker unit is embedded and fixed in an installation recess of the sound box housing. The sound box housing has a first side and a second side opposite to the first side, and the height of the sound box housing on the first side is greater than the height of the sound box housing on the second side. The height of the sound box housing gradually decreases from the first side to the second side. The width of the sound box housing between the first side and the second side is less than or equal to the width of the speaker unit.

11 Claims, 3 Drawing Sheets

SOUND BOX STRUCTURE

BACKGROUND OF THE INVENTION

1. Field of the Invention

The invention relates to the technical field of acoustic devices, in particular to a miniature sound box structure.

2. Description of the Prior Art

A loudspeaker is a kind of transducer element that converts electrical signals into acoustic signals, and is an important acoustic component in electronic products. The speaker module usually includes a frame and a magnetic system and a vibration system disposed within the frame. The vibration system includes a diaphragm and a voice coil arranged under the diaphragm. The voice coil drives the diaphragm to produce sound via the vibration of the magnetic system.

Typically, a sound box usually has a speaker unit assembled between the upper cover of the sound box and the lower cover of the sound box, wherein the speaker unit is fixed on the inner side of the upper cover of the sound box.

With the high pursuit of portability of electronic products, reducing the size is a necessary goal when updating various micro-speaker products, but the reduction in volume means that the volume of the micro-speakers and the sound box must be reduced at the same time. In the prior art, for example, a speaker embedded in the keyboard of a notebook computer has the disadvantage that it is not easy to shrink in structure.

SUMMARY OF THE INVENTION

It is one objective of the present invention to provide an improved miniature sound box structure, so as to solve the above-mentioned problems of the prior art.

In order to achieve the above objectives, the present disclosure provides the following technical solutions.

According to one aspect of the invention, a sound box structure includes a speaker unit; and a sound box housing. The speaker unit is embedded and fixed in an installation recess of the sound box housing. The sound box housing has a first side and a second side opposite to the first side, and a height of the sound box housing on the first side is greater than a height of the sound box housing on the second side. The height of the sound box housing gradually decreases from the first side to the second side. The width of the sound box housing between the first side and the second side is less than or equal to a width of the speaker unit. The width between the first side and the second side is a distance from an inner wall of the sound box housing on the first side to an inner wall the sound box housing on the second side.

According to some embodiments, the speaker unit includes a frame body, a drum paper disposed on the frame body, a magnet disposed in the frame body, and a voice coil disposed in the frame body and surrounding the magnet, a washer disposed above the magnet, and a yoke located under the magnet.

According to some embodiments, the drum paper comprises a diaphragm and a surround encircling the diaphragm.

According to some embodiments, the frame body of the speaker unit is fixed to a connecting portion at a periphery of the installation recess.

According to some embodiments, the sound box housing comprises an upper cover and a lower cover.

According to some embodiments, a surface of the drum paper of the speaker unit is lower than an upper surface of the upper cover on both sides of the speaker unit.

According to some embodiments, at least a foam tape is provided on the surface of the upper cover.

According to some embodiments, a first slit is disposed between the upper cover and the lower cover on the first side of the sound box housing, wherein a second slit is disposed on a bottom surface of the lower cover, and wherein a length of the first slit and the second slit is greater than a length of a side of the yoke.

According to some embodiments, a part of the side of the yoke is exposed by the first slit.

According to some embodiments, a foam tape is provided on the bottom surface of the lower cover to cover the second slit.

According to some embodiments, sealing glue or a plastic sheet is disposed on the bottom surface of the lower cover to cover the second slit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
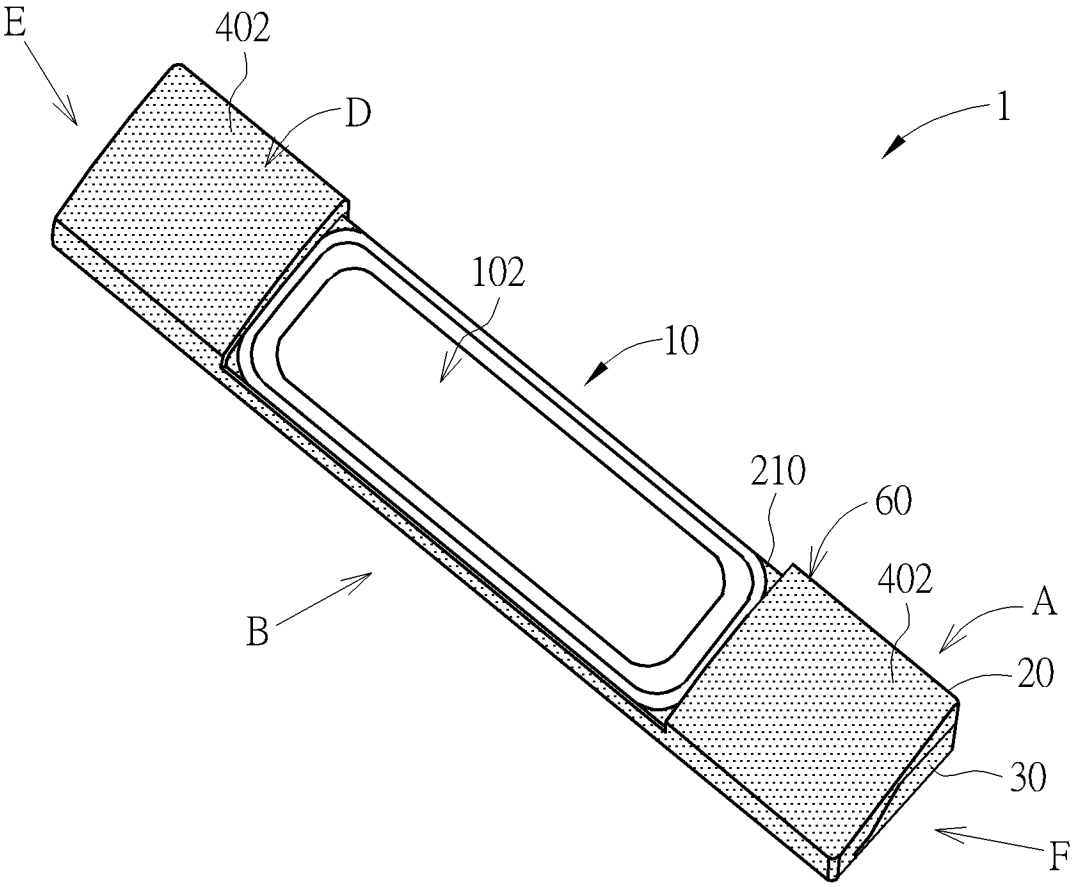
FIG. 1 is a schematic diagram showing the appearance of the miniature sound box structure according to an embodiment of the present invention.

In order to make the objectives, technical solutions, and advantages of the embodiments of the present invention clearer, the technical solutions in the embodiments of the present invention will be described clearly and completely in conjunction with the accompanying drawings in the embodiments of the present invention. Obviously, the described embodiments are part of the embodiments of the present invention, but not all of the embodiments. Based on the embodiments of the present invention, all other embodiments obtained by those of ordinary skill in the art without creative work shall fall within the protection scope of the present invention. Therefore, the following detailed description of the embodiments of the present invention provided in the accompanying drawings is not intended to limit the scope of the claimed invention, but merely represents selected embodiments of the present invention.

In the description of the present invention, it should be understood that the terms "center", "longitudinal", "transverse", 'length", "width", "thickness", "upper", "lower", "front", "back", "left", "Right", "vertical", "horizontal", "top", "bottom", "inner", "outer", "clockwise", "counterclockwise" and other directions or the positional relationship are based on the orientation or positional relationship shown in the drawings, and is only for the convenience of describing the present invention and simplifying the description, and does not indicate or imply that the pointed device or element must have a specific orientation, be constructed and operated in a specific orientation, Therefore, it shall not be interpreted as a limitation to the present invention.

In the present invention, unless otherwise clearly defined and specified, the "above" or "below" of the first feature of the second feature may include direct contact between the first and second features, or may include the first and second features not in direct contact but through other features between them. Moreover, "above", "above" and "above" the second feature of the first feature include the first feature being directly above and obliquely above the second feature, or it simply means that the first feature is higher in level than the second feature. The "below", "below" and "below" of the second feature of the first feature include the first feature directly below and obliquely below the second feature, or it simply means that the level of the first feature is smaller than the second feature.

Figure 2:
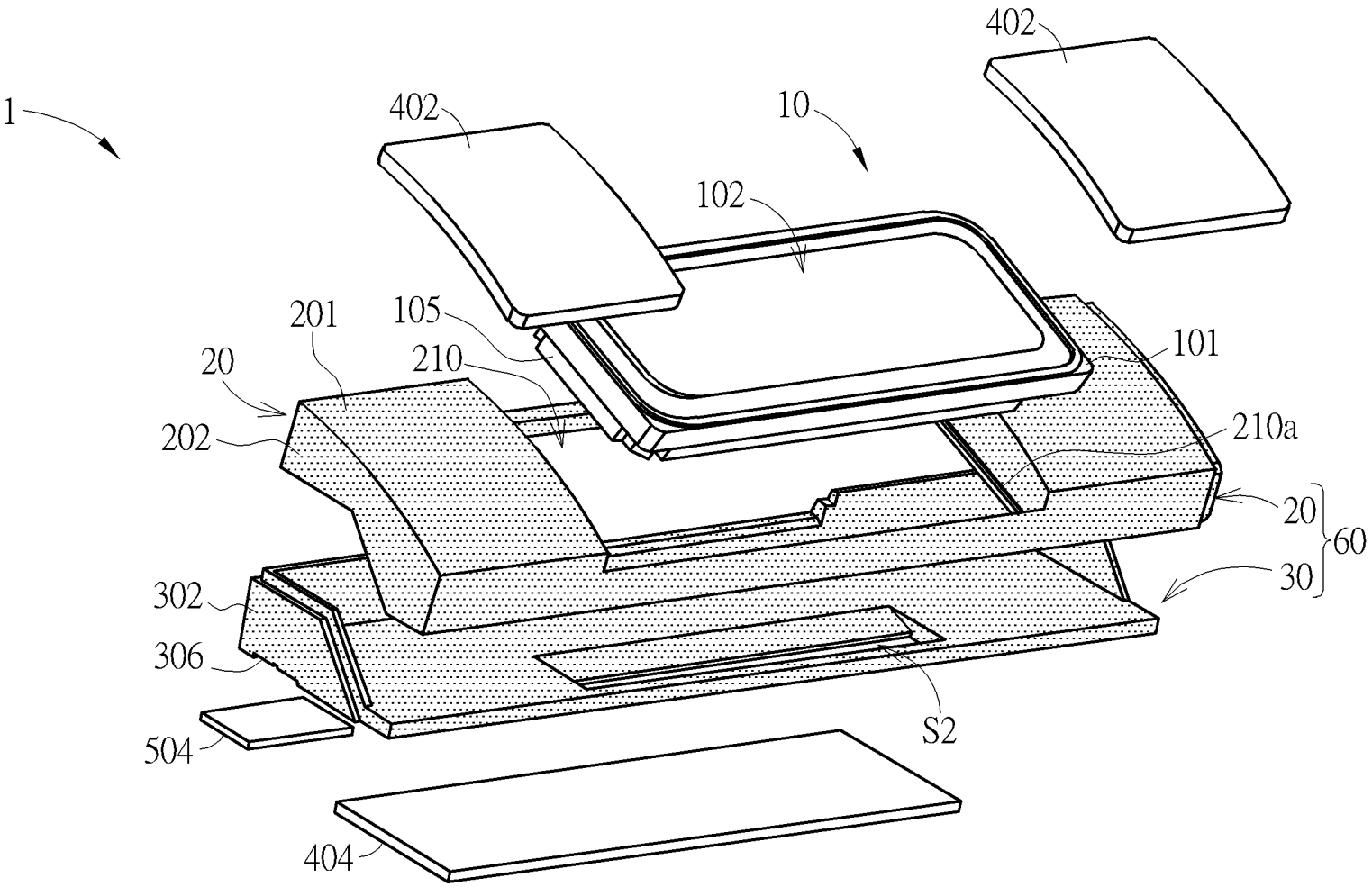
FIG. 2 is an exploded view of the miniature sound box structure in FIG. 1.
Figure 3:
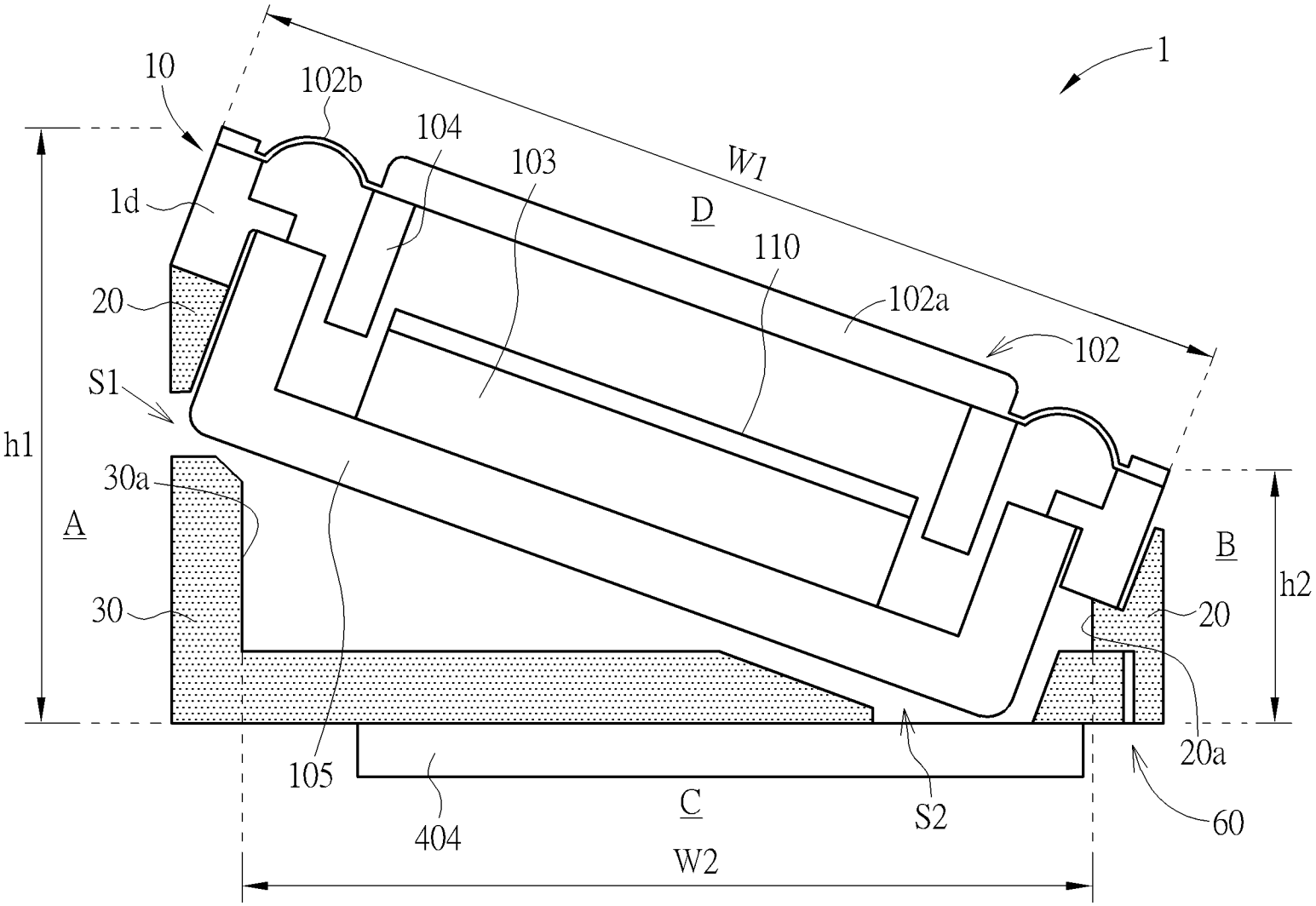
FIG. 3 is a schematic, cross-sectional view of the miniature sound box structure in FIG. 1.

Please refer to FIG. 1 to FIG. 3. FIG. 1 is a schematic diagram showing the appearance of the miniature sound box structure according to an embodiment of the present invention. FIG. 2 is an exploded view of the miniature sound box structure in FIG. 1. FIG. 3 is a schematic, cross-sectional view of the miniature sound box structure in FIG. 1.

As shown in FIG. 1 to FIG. 3, according to an embodiment of the present invention, the miniature sound box structure 1 includes a speaker unit 10 and a sound box housing 60. According to an embodiment of the present invention, the sound box housing 60 may be a two-piece structure. For example, the sound box housing 60 may be composed of an upper cover 20 and a lower cover 30. Those skilled in the art should understand that the sound box housing 60 in FIG. 1 to FIG. 3 is only an example. In other embodiments, the sound box housing 60 may be a single piece instead of two pieces. According to an embodiment of the present invention, the speaker unit 10 is inserted into the installation recess 210 of the upper cover 20 from the outside at a predetermined angle, and the frame body 101 of the speaker unit 10 can be fixed to the corresponding connecting portion 210*a* at the peripheral edge of the installation recess 210 through glue or adhesive tape. According to an embodiment of the present invention, the upper cover 20 and the lower cover 30 may be made of plastic, but are not limited thereto.

According to an embodiment of the present invention, the speaker unit 10 generally includes a frame body 101, a drum paper 102 arranged on the frame body 101, a magnet 103 arranged in the frame body 101, and a voice coil 104 arranged in the frame body 101 and surrounding the magnet 103, a washer 110 disposed above the magnet 103, and a yoke 105 below the magnet 103.

According to an embodiment of the present invention, the drum paper 102 may include a diaphragm 102*a* and a surround 102*b* that encircles the diaphragm 102*a*. The surround 102*b* has an arc-shaped or wavy-shaped cross-section. According to an embodiment of the present invention, the diaphragm 102*a* and the surround 102*b* may be made of different materials, but are not limited thereto.

According to an embodiment of the present invention, preferably, the drum paper 102 is flexibly connected to the upper end of the frame body 101. According to an embodiment of the present invention, the diaphragm 102*a* is arranged in a slender shape, that is, the size in the length direction is larger than the size in the width direction. According to an embodiment of the present invention, the frame body 101 has an opening that matches the shape of the drum paper 102 and the diaphragm 102*a*, and the diaphragm 102*a* is connected to the frame body 101 through the ring-shaped surround 102*b* to seal the opening.

According to an embodiment of the present invention, as shown in FIG. 3, a voice coil 104 is provided in the frame body 101. According to an embodiment of the present invention, the voice coil 40 is formed by windings of insulated wire and does not require a bobbin. The voice coil 40 is disposed around the outer periphery of the magnet 103. According to an embodiment of the present invention, the voice coil 104 is arranged in a slender shape, that is, the size in the length direction is larger than the size in the width direction, and the upper end of the voice coil 104 is fixedly connected to the diaphragm 201. Preferably, in an embodiment of the present invention, the center of the voice coil 104 is located on the central axis of the diaphragm 102*a* in the longitudinal direction. A magnetic field is provided through the magnet 103 to vibrate the voice coil 104 and drive the diaphragm 102*a* to vibrate and produce sound.

As can be seen from FIG. 1 and FIG. 3, the appearance of the miniature sound box structure 1 of the present invention has six sides: A to F sides. The height h1 of the sound box housing 60 of the miniature sound box structure 1 on the A side is greater than its height h2 on the B side. As can be seen in FIG. 3, the height of the sound box housing 60 gradually decreases from the A side to the B side. The width W2 of the sound box housing 60 (i.e., the distance from the inner wall 30*a* of the lower cover 30 on the A side to the inner wall 20*a* of the upper cover 20 on the B side) is smaller than the width W1 of the speaker unit 10. According to an embodiment of the present invention, as can be seen in FIG. 1 and FIG. 2, the upper cover 20 and the lower cover 30 have side wall structures 202 and 302 with complementary shapes on the E side and the F side, and a chamber is formed between the upper cover 20 and the lower cover 30 after assembly.

According to an embodiment of the present invention, when the miniature sound box structure 1 of the present invention is installed in, for example, a keyboard of a laptop computer, the C side of the miniature sound box structure 1 faces the C side (or C-plane) of the laptop, and the D side of the miniature sound box structure 1 faces the D side of the laptop.

It can be seen from FIG. 1 that in the appearance of the miniature sound box structure 1, the upper surface of the drum paper 102 of the speaker unit 10 is slightly lower than the surface 201 of the upper cover 20 on both sides of the speaker unit 10, for example, by about 0.5 mm, to free a space that allows the drum paper 102 to vibrate. According to an embodiment of the present invention, at least a foam tape 402 may be provided on the surface 201 of the upper cover 20 located on both sides of the speaker unit 10.

According to an embodiment of the present invention, no ventilation holes or apertures are provided on the bottom surface of the yoke 105 of the speaker unit 10, and there are no punching holes or perforations to avoid the risk of air leakage. According to an embodiment of the present invention, the four corners of the side surface of the yoke 105 of the speaker unit 10 may have holes (not shown). It can be seen from FIG. 3 that the sound box housing 60 of the miniature sound box structure 1 has a slit S1 on the A side. For example, the slit S1 is located between the upper cover 20 and the lower cover 30. The sound box housing 60 of the miniature sound box structure 1 has a slit S2 on the C side. For example, the slit S2 is located on the lower cover 30. In order to leave room for glue, the length of the slit S1 and the slit S2 is slightly larger than the length of the side of the yoke 105. In the appearance of the miniature sound box structure 1, the side of the yoke 105 that is partially exposed can be seen through the slit S1 on the A side of the miniature sound box structure 1.

According to an embodiment of the present invention, on the bottom surface of the lower cover 30 on the C side of the miniature sound box structure 1, a foam tape 404 can be provided to cover the slit S2, so in appearance, the yoke 105 cannot be seen from the C side of the miniature sound box structure 1. In addition, sealant or plastic sheet, for example, Mylar and other polyester film, or other air-tight materials can be used to cover the slit S2.

According to an embodiment of the present invention, as shown in FIG. 2, a ventilation hole 306 may be provided on the lower cover 30 of the miniature sound box structure 1 close to the side wall structure 302. For example, a channel may be formed on the bottom surface of the lower cover. One end of the channel communicates with the chamber formed between the upper cover 20 and the lower cover 30. The channel is covered with a plastic sheet 504 such as Mylar or polyester film, to form the ventilation hole 306, which is used to balance the internal and external air pressure of the miniature sound box structure 1.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound box structure, comprising:

a speaker unit; and a sound box housing, characterized in that the speaker unit is embedded and fixed in an installation recess of the sound box housing;

wherein the sound box housing has a first side and a second side opposite to the first side, and a height of the sound box housing on the first side is greater than a height of the sound box housing on the second side, and the height of the sound box housing gradually decreases from the first side to the second side, and the width of the sound box housing between the first side and the second side is less than or equal to a width of the speaker unit, wherein the width between the first side and the second side is a distance from an inner wall of the sound box housing on the first side to an inner wall the sound box housing on the second side.

2. The sound box structure according to claim 1, wherein the speaker unit includes a frame body, a drum paper disposed on the frame body, a magnet disposed in the frame body, and a voice coil disposed in the frame body and surrounding the magnet, a washer disposed above the magnet, and a yoke located under the magnet.

3. The sound box structure according to claim 2, wherein the drum paper comprises a diaphragm and a surround encircling the diaphragm.

4. The sound box structure according to claim 2, wherein the frame body of the speaker unit is fixed to a connecting portion at a periphery of the installation recess.

5. The sound box structure according to claim 2, wherein the sound box housing comprises an upper cover and a lower cover.

6. The sound box structure according to claim 5, wherein a surface of the drum paper of the speaker unit is lower than a surface of the upper cover on both sides of the speaker unit.

7. The sound box structure according to claim 6, wherein at least a foam tape is provided on the surface of the upper cover.

8. The sound box structure according to claim 5, wherein a first slit is disposed between the upper cover and the lower cover on the first side of the sound box housing, wherein a second slit is disposed on a bottom surface of the lower cover, and wherein a length of the first slit and the second slit is greater than a length of a side of the yoke.

9. The sound box structure according to claim 8, wherein a part of the side of the yoke is exposed by the first slit.

10. The sound box structure according to claim 8, wherein a foam tape is provided on the bottom surface of the lower cover to cover the second slit.

11. The sound box structure according to claim 8, wherein sealing glue or a plastic sheet is disposed on the bottom surface of the lower cover to cover the second slit.

* * * * *